US008573313B2

(12) United States Patent
Lovell et al.

(10) Patent No.: US 8,573,313 B2
(45) **Date of Patent: *Nov. 5, 2013**

(54) WELL SERVICING METHODS AND SYSTEMS

(75) Inventors: John R. Lovell, Houston, TX (US); Sarmad Adnan, Sugar Land, TX (US); Jospeh A. Ayoub, Katy, TX (US); Michael G. Gay, Dickinson, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/278,512

(22) Filed: Apr. 3, 2006

(65) Prior Publication Data

US 2007/0227741 A1 Oct. 4, 2007

(51) Int. Cl.

| | |
|---|---|
| ***E21B 47/00*** | (2012.01) |
| ***E21B 23/08*** | (2006.01) |
| ***E21B 33/05*** | (2006.01) |
| ***E21B 23/14*** | (2006.01) |

(52) U.S. Cl.

CPC ..... *E21B 23/14* (2013.01); *E21B 33/05* (2013.01)

USPC ..... 166/385; 166/250.01; 166/70; 166/77.1

(58) Field of Classification Search

USPC ..... 166/385, 250.01, 70, 77.1, 66

See application file for complete search history.

(56) References Cited

U.S. PATENT DOCUMENTS

| | | | | |
|---|---|---|---|---|
| 2,283,048 | A | | 5/1942 | Collett, Jr. |
| 3,819,420 | A | * | 6/1974 | Schmidt et al. ..... 136/228 |
| 3,831,676 | A | | 8/1974 | Brown et al. |
| 4,585,061 | A | | 4/1986 | Lyons |
| 4,952,012 | A | * | 8/1990 | Stamnitz ..... 385/101 |
| 4,997,256 | A | | 3/1991 | Sano |
| 5,022,634 | A | | 6/1991 | Keeble |
| 5,143,353 | A | | 9/1992 | Sano |
| 5,163,657 | A | | 11/1992 | Sano |
| 5,176,207 | A | * | 1/1993 | Keller ..... 166/64 |
| 5,199,689 | A | * | 4/1993 | Proud et al. ..... 254/134.4 |

(Continued)

FOREIGN PATENT DOCUMENTS

| | | |
|---|---|---|
| GB | 2404938 | 2/2005 |
| WO | 9609461 | 3/1996 |

(Continued)

OTHER PUBLICATIONS

Office Action to Chinese Patent Application Serial No. 200780020587.0 dated Feb. 27, 2012.

*Primary Examiner* — Cathleen Hutchins
(74) *Attorney, Agent, or Firm* — Michael Flynn

(57) ABSTRACT

Well servicing methods and systems are described, in one embodiment comprising a pressure containment housing fluidly connected directly to a wellhead of a wellbore, and a reel positioned inside the housing on which is spooled a communication line. One method comprises introducing the communication line into the pressurized wellbore without a well control stack, the communication line being introduced and driven into the wellbore by controlling a reel, the reel being internal to a pressurized housing removably connected directly to a wellhead of the wellbore. Fluid flow may move the communication line to a desired location in the wellbore. This abstract allows a searcher or other reader to quickly ascertain the subject matter of the disclosure. It may not be used to interpret or limit the scope or meaning of the claims. 37 CFR 1.72(b)

32 Claims, 4 Drawing Sheets

(56) References Cited

U.S. PATENT DOCUMENTS

| | | | | |
|---|---|---|---|---|
| 5,205,542 | A * | 4/1993 | Keeble | 254/134.4 |
| 5,234,198 | A | 8/1993 | Hale | |
| 5,358,218 | A | 10/1994 | Terasawa et al. | |
| 5,467,968 | A | 11/1995 | Proud | |
| 5,555,335 | A | 9/1996 | Baker | |
| 5,557,703 | A | 9/1996 | Barker | |
| 5,570,437 | A | 10/1996 | Kluth | |
| 5,699,974 | A | 12/1997 | Jenkins | |
| 5,804,713 | A | 9/1998 | Kluth | |
| 5,841,131 | A | 11/1998 | Schroeder et al. | |
| 5,872,876 | A | 2/1999 | Kluth | |
| 6,006,828 | A | 12/1999 | Kluth | |
| 6,273,188 | B1 | 8/2001 | McCafferty | |
| 6,498,988 | B1 | 12/2002 | Robert et al. | |
| 6,644,402 | B1 | 11/2003 | Sharma | |
| 6,655,453 | B2 * | 12/2003 | Head | 166/77.1 |
| 6,863,124 | B2 * | 3/2005 | Araux et al. | 166/66.4 |
| 6,955,218 | B2 | 10/2005 | Coon | |
| 6,978,832 | B2 | 12/2005 | Gardner | |
| 6,983,796 | B2 | 1/2006 | Bayne | |
| 6,997,256 | B2 | 2/2006 | Williams | |
| 7,082,993 | B2 * | 8/2006 | Ayoub et al. | 166/250.1 |
| 2003/0042019 | A1 | 3/2003 | Harkins et al. | |
| 2004/0007059 | A1 * | 1/2004 | Tudor | 73/152.42 |
| 2004/0040705 | A1 * | 3/2004 | Harkins | 166/250.01 |
| 2004/0045705 | A1 * | 3/2004 | Gardner et al. | 166/250.01 |
| 2004/0065444 | A1 * | 4/2004 | Smith et al. | 166/381 |
| 2004/0129418 | A1 | 7/2004 | Jee | |
| 2005/0034857 | A1 * | 2/2005 | Defretin et al. | 166/250.01 |
| 2005/0034873 | A1 | 2/2005 | Coon | |
| 2005/0109518 | A1 * | 5/2005 | Blacklaw | 166/383 |
| 2005/0126777 | A1 | 6/2005 | Rolovic | |
| 2005/0236161 | A1 * | 10/2005 | Gay et al. | 166/380 |
| 2005/0263281 | A1 * | 12/2005 | Lovell et al. | 166/255.1 |
| 2006/0102342 | A1 * | 5/2006 | East et al. | 166/250.1 |

FOREIGN PATENT DOCUMENTS

| | | | |
|---|---|---|---|
| WO | 9609561 | | 3/1996 |
| WO | 0049273 | A | 8/2000 |
| WO | 03102370 | | 12/2003 |
| WO | 2005/045174 | | 5/2005 |
| WO | 2005/045175 | | 5/2005 |
| WO | 2005/045185 | | 5/2005 |
| WO | 2006003208 | A1 | 1/2006 |

* cited by examiner

WELL SERVICING METHODS AND SYSTEMS

BACKGROUND OF THE INVENTION

1. Field of Invention

The present invention relates generally to the field of well servicing of oil and gas wells, and more particularly to methods and systems useful in well servicing operations such as well stimulation.

2. Related Art

The production of hydrocarbon from reservoirs requires permanently installed wellbores in the ground composed of a multiplicity of largely tubular structures referred to as the wellbore completion. Increasing the production of hydrocarbon typically requires the pumping of a fluid down the wellbore and into the reservoir. Some fluids are designed to increase the flow of hydrocarbon, others impede the flow of water or build-up of scale. Measurements may be made of fluid flow-rate, pressure, etc, at the surface to optimize the treatment. This monitoring operation is non-trivial, however, because the fluids are typically highly non-Newtonian with pressure-drops along the completion that are difficult to determine in advance. The stimulation fluid may include solid particles, such as proppant, which further complicates the monitoring and job optimization.

Solutions to provide a more advanced monitoring capability are known in the industry. For example, a spoolable metallic tube may be run into the well, with the stimulation fluid pumped around that tube. In that case the downhole pressure may be inferred from a pressure measurement made in the interior of the tube. With no fluid flowing down the tube, this inference is relatively simple. Such a tube is often referred to as a "dead-string". Spoolable tubes known in the industry are typically brought to the rig already coiled around a drum that is mounted onto a large truck. This coiled tubing may vary from 0.25" to bigger than 3.0" in diameter. An advantage of the larger size tubing is that cable may be pumped into that coiled tubing before the job, sensors may be attached to the distal end of that cable, and then when the coiled tubing is run into the ground, those sensors may transmit downhole data to the surface. Another advantage of the larger tubing is that it may be possible to pump fluid down the tubing even with the cable in the tubing. Such a system need not be limited to reservoir stimulation but may be used for general wellbore treatments as has been disclosed in, for example, U.S. Pub. Pat. App. No. 20050126777, published Jun. 16, 2005. Traditional cables used in the industry consist of a multiplicity of electrical lines, but more recently optical fibers have been added. These provide higher data rates, but also introduce the possibility of distributed sensing, wherein the cable itself becomes the sensor. Such a system has been disclosed, for example, in U.S. Pub. Pat. App. No. 20040129418, published Jul. 8, 2004.

Unfortunately, there may be disadvantages to having the coiled tubing in the wellbore during the stimulation treatment. The annular space around the tubing may be less than one or two inches, which increases the friction pressure when the fluid is pumped and so increases the surface horsepower required to do the job, compared with pumping straight into the wellbore—a process known as bull-heading. Abrasive and corrosive fluids are often needed to optimize the subsequent hydrocarbon flow. These fluids may also damage the coiled tubing leading to high maintenance costs for the service. Another disadvantage is the large apparatus needed to convey the coiled tubing into the wellbore such as disclosed, for example in U.S. Pat. No. 6,273,188. In particular, to avoid crushing the coiled tubing, a large injection apparatus is required to provide the axial conveyance force into, and out of, the wellbore as disclosed, for example, in U.S. Pat. No. 4,585,061 "Apparatus for inserting and withdrawing coiled tubing with respect to a well" by Lyons et al. In many cases, the cost of such systems may be prohibitive compared to the benefit of the real-time downhole data, so the industry has come to accept taking surface measurements and making inferences of the downhole state.

U.S. Pub. Pat. App. No. 20050263281, published Dec. 1, 2005, discloses applications of real-time downhole data to stimulation operations, but presupposes that the optical fiber is first contained inside a tubular, and the tubular then run into the well. U.S. Pub. Pat. App. No. 20050236161, published Oct. 27, 2005, discloses pumping a fluid into a tubular and deploying a fiber optic tube into the tubular by propelling it in the flow of the pumped fluid. This document also discusses a method of communicating in a wellbore using a fiber optic tube disposed within a wellbore tubular. In certain embodiments, this communication may be combined with a wireless communication system at the surface. In certain embodiments, the tubular may be coiled tubing and the fiber optic tube may be deployed in the coiled tubing while the tubing is spooled on a reel or while the tubing is deployed in a wellbore. As used in this reference the phrases "fiber optic tube" and "fiber optic tether" are used to identify the combination of an optical fiber or multiple optical fibers disposed in a duct. The term "fiber optic cable" refers to a cable, wire, wireline or slickline that comprises one or more optical fibers.

It would be a revolutionary advance in the art if methods and systems could be devised that allow collection of downhole data during a stimulation or other wellbore treatment operation, but which do not require ancillary apparatus to inject or remove coiled tubing or other tubular from the wellbore.

SUMMARY OF THE INVENTION

In accordance with the present invention, well servicing methods and systems for carrying out the methods are described that reduce or overcome problems in previously known methods and systems.

A first aspect of the invention are methods of introducing a communication line into a wellbore, one method comprising:

(a) pumping a treatment fluid through the wellbore and into the reservoir; and (b) using the treatment fluid for propelling the communication line into the wellbore without significant damage to the communication line.

As used herein the term "communication line" means a member that is able to transmit electronic, optical or other signals in at least one direction, and may be spoolable onto a reel or spool. The term "propelling" as used herein means the communication line is forced down into the wellbore either by a powered reel or spool, or by flowing a treatment fluid into the wellbore, or combination thereof. Power may be supplied to the reel in many ways such as providing direct power (e.g. via a bulkhead) or battery power to the reel. The reel may be instrumented to measure and control line unspooling/spooling length based on a controller input via a communication port (via wire, wireless, or combination thereof). The phrase "without significant damage to the communication line" means that the communication line should not lose its essential function or functions because of abrasion or other abuse during transit into the wellbore. For an optical fiber this might mean that the optical fiber is not crimped or otherwise bent in a way that optical signals may not be transmitted through the fiber. By "wellbore", we mean the innermost tubular of the completion system. "Tubular" and "tubing" refer to a conduit or any kind of a round hollow apparatus in general, and in the area of oilfield applications to casing, drill pipe, metal tube, or coiled tubing or other such apparatus. Methods of the invention include those comprising introducing the communication line into a well control stack removably connected to a wellhead of the wellbore. Other methods of the invention are those comprising introducing the communication line into the pressurized wellbore without a well control stack, the communication line being introduced and propelled into the wellbore by a powered reel, the powered reel being internal to a pressurized housing removably connected directly to a wellhead of the wellbore. Other methods include connecting the housing and powered reel directly to the wellhead prior to introducing the communication line into the pressurized wellbore. Certain embodiments of the methods comprise flanging the housing directly to the wellhead.

In certain methods of the invention the communication line comprises an optical fiber, and power to turn the powered reel is delivered magnetically through a non-magnetic wall of the housing. Exemplary methods of the invention may include diffusing an optical signal using a first optical connector, transmitting the diffused signal through the optical fiber to a second optical connector, and refocusing the signal to the diameter of the optical fiber. The signal may be transmitted through an optical pressure bulkhead in a wall of the housing; optionally, optical signals may be transmitted in both directions in duplex fashion through the optical fiber. One or more than one optical fibers may be used. In certain other method embodiments the communication line may be a wire, such as a micro-wire, and an electrical signal is conveyed to a data acquisition system by means selected from wireless and wire transmission means.

Exemplary method embodiments may be those wherein the communication line is guided by a guide mechanism, which may also function to retrieve the communication line from the wellbore. Alternatively, the communication line may be left in the wellbore and dissolved by chemical, thermal, physical, or combination of these actions.

Other exemplary method embodiments of the invention are those wherein the communication line is driven into the wellbore by a pumping system that pumps one or more fluids into the wellbore. One or more than one fluids may be pumped into the wellbore in succession to drive the communication line into the wellbore. The pumping systems may include mixing or combining devices, wherein fluids and/or solids may be mixed or combined prior to being pumped into the wellbore. The mixing or combining device may be controlled in a number of ways, including, but not limited to, using data obtained either downhole from the wellbore, surface data, or some combination thereof. Methods of the invention may include using a surface data acquisition and/or analysis system, such as described in assignee's U.S. Pat. No. 6,498,988, incorporated by reference herein. Certain methods of the invention are those wherein a first fluid is pumped into the wellbore to un-spool the communication line, followed by one or more subsequent fluids. A portion of the fiber may comprise a protective coating or sheath and the optical fiber may be re-spooled.

Yet other methods of the invention are those comprising sensing a wellbore condition, comprising methods selected from using a sensor attached to a distal end of the communication line, in the case of optical fiber using gratings on the optical fiber, and/or doping the optical fiber, and combinations thereof. The data may be used to monitor a well treatment operation, or model subsequent well treatment operations. The well treatment operation may comprise at least one adjustable parameter and the methods may include adjusting the parameter. The methods are particularly desirable when the property is measured as a well treatment operation is performed, when a parameter of the well treatment operation is being adjusted or when the measurement and the conveying of the measured property are performed in real time.

Often the well treatment operation may involve injecting at least one fluid into the wellbore, such as injecting a fluid into the coiled tubing, into the wellbore annulus, or both. In some operations, more than one fluid may be injected or different fluids may be injected into the coiled tubing and the annulus. The well treatment operation may comprise providing fluids to stimulate hydrocarbon flow or to impede water flow from a subterranean formation. In some embodiments, the well treatment operation may include communicating via the communication line with a tool in the wellbore, and in particular communicating from surface equipment to a tool in the wellbore. The measured property may be any property that may be measured downhole, including but not limited to pressure, temperature, pH, amount of precipitate, fluid temperature, depth, presence of gas, chemical luminescence, gamma-ray, resistivity, salinity, fluid flow, fluid compressibility, tool location, presence of a casing collar locator, tool state and tool orientation. In particular embodiments, the measured property may be a distributed range of measurements across an interval of a wellbore such as across a branch of a multi-lateral well. The parameter of the well treatment operation may be any parameter that may be adjusted, including but not limited to quantity of injection fluid, relative proportions of each fluid in a set of injected fluids, the chemical concentration of each material in a set of injected materials, the relative proportion of fluids being pumped in the annulus to fluids being pumped in the coiled tubing, concentration of catalyst to be released, concentration of polymer, concentration of proppant, and location of coiled tubing.

Another aspect of the invention are systems for carrying out the inventive methods, one inventive system comprising:

(a) a reel for propelling a communication line into a pressurized wellbore, (b) the reel mounted directly on top of a well control stack fluidly connected to the pressurized wellbore.

Systems within this aspect of the invention include those wherein the communication line is selected from optical fibers, micro-wires, and the like, and wherein the well control stack may be selected from a blowout preventer (BOP), stuffing box, lubricator, and functional equivalents thereof. Systems of this aspect of the invention reduce or eliminate bending that may cause fatigue and ultimate failure of the communication line. Systems may include means for collecting wellbore data, and these means may be part of the hub of the reel spool. Systems of this aspect of the invention reduce the number of components and pieces of equipment required and the complexity of the service setup. This should also reduce the amount of time required for rigging up and rigging down the system.

Another system of the invention comprises:

(a) a pressure containment housing fluidly connected directly to a wellhead of a wellbore; and (b) a reel positioned inside the housing on which is spooled a communication line.

Systems of this aspect of the invention include those wherein a drive mechanism for the reel is also located within the housing, as well as a data interface. As used herein the phrase "fluidly connected" means the housing may be temporarily or permanently, but in any case securely, attached to the wellhead by means such as flanges, welds, clamps, and the like, as along as the mechanism of attachment allows wellhead pressure to be maintained in the housing at least long enough for the communication line to be un-spooled to a usable depth and/or location in the wellbore, and re-spooled, if desired. The pressure containment housing should have no fluid leak paths and should require no or minimal pressure testing. Power to turn the reel may be delivered magnetically though a non-magnetic housing wall or portion of wall, for example using a magnetic coupling. Thus an electrical or hydraulic motor may turn the reel from outside the housing without having to penetrate a wall of the housing. In system embodiments wherein the communication line is an optical fiber, the optical signal may be diffused (to improve contamination tolerance) at the optical connector device, passed from a rotating hub of the reel to a diffused optical connector which refocuses the optical signal to the diameter of the optical fiber. The optical fiber would then be passed through an optical pressure bulkhead in the housing wall and be available outside the housing. This may be a full duplex arrangement, wherein light beams may travel into and out of the wellbore.

If the communication line is a micro-wire, then an electrical signal may be converted into a wireless signal to bypass the need for a signal collector at the hub of the reel. In these embodiments, a receiver device might simply comprise a non-EMF-blocking port in the housing (comprising materials such as plastics, quartz, ceramic, or combination thereof).

The optical fiber or micro-wire may be guided into an appropriate position in the well flow by an articulating guide. The appropriate position in the well flow may be a function of well type, type of well treatment and the phase (stage) of the treatment. For example, during deployment it may be beneficial to center the fiber in the well flow so as to maintain the maximum possible frictional drag on the fiber. However, during high velocity or abrasive treatments, it may be beneficial to move the fiber to one side (in the least turbulent or least destructive (to the fiber) part of the flow). In certain embodiments, when the communication line is a small diameter fiber used in fracturing service, it may be more economical to simply leave the fiber in the well. However, in other embodiments, such as well logging operations, it may make more sense to retrieve the fiber from the well. If the communication line is a micro-wire (single or multi conductor) it too may be made of materials (such as zinc or aluminum) that would not last long in a well or that may simply be dissolved by an acid flush. In embodiments wherein the communication line comprises one or more multi-use micro-wires, the micro-wires may comprise materials (Inconel, Monel, and the like) that are not harmed by typical well treatment fluids.

Systems of the invention may include one or more oilfield tool components. The term "oilfield tool component" includes oilfield tools, tool strings, deployment bars, coiled tubing, jointed tubing, wireline sections, slickline sections, combinations thereof, and the like adapted to be run through one or more oilfield pressure control components. The term "oilfield pressure control component" may include a BOP, a lubricator, a riser pipe, a wellhead, or combinations thereof. Systems may include and methods may employ magnetic sensors, such as magnetometers, Hall effect sensors, magneto resistors, magneto diodes, and combinations thereof.

Advantages of the systems and methods of the invention include compactness and lightweight, with no need for a truck to log a well; less trained or less skilled operators may be needed; low power requirements for running in hole and pulling out of hole; easier well control, since no BOP, stripper, lubricator, or stuffing box need be used. Systems of the invention may be dressed in the yard and be ready to be connected on the wellhead more quickly, and no slip ring or rotary collector is required. Low cost deployment of optical fiber and micro-wire should be realistic, and stringent and expensive intrinsic safety requirements, such as electrical codes in hazardous areas, may be eliminated.

Systems and methods of the invention may become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

Figure 1:
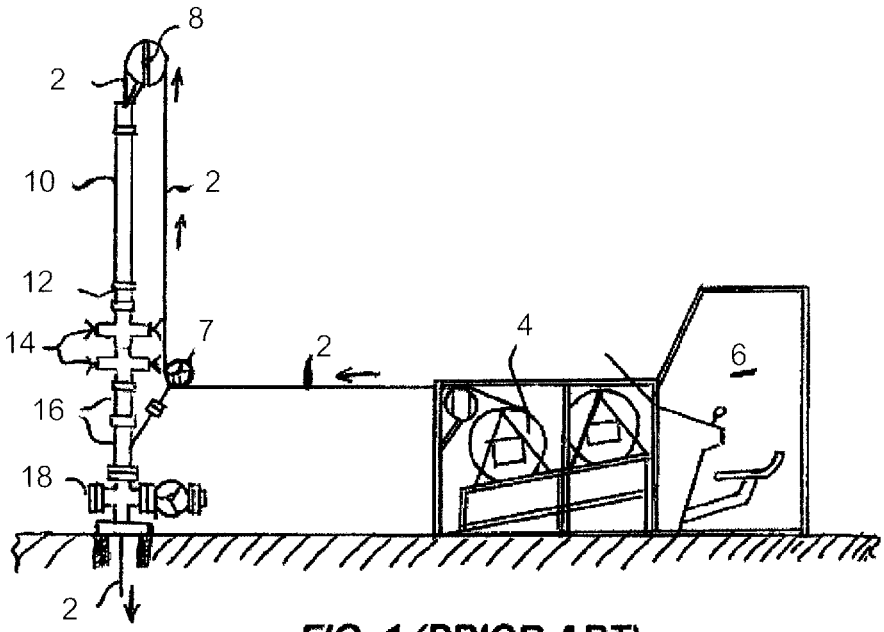
FIG. 1 (PRIOR ART)
FIG. 1. is a schematic partial cross-sectional view of a prior art system.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it may be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes well servicing methods and systems for use in same that either are more cost effective than presently used methods and systems, or provide the opportunity to access wellbore and surface data more readily to better control well servicing parameters. Currently, while operation of optical fiber and micro-wire deployment systems are generally adequate for their purposes, there remains room for improvement. One problem is the amount of and large size of equipment presently used. For example, coiled tubing systems presently require trucking in the coiled tubing deployment system. Ideally it would be better if smaller, less expensive deployment equipment may be used. Another challenge is to develop systems and methods for deploying communication lines which do not require elaborate rigging up or rigging down. It would be an advance in the art if some operations may be combined, such as deployment of a communication line and injection of one or more treatment fluids into a well, so that collection of data is possible at various locations in the wellbore during fluid injection, which is not possible when the communication line is inserted along with coiled tubing. There is a continuing need for systems and methods that address one or more of these challenges.

By "well servicing", we mean any operation designed to increase hydrocarbon recovery from a reservoir, reduce non-hydrocarbon recovery (when non-hydrocarbons are present), or combinations thereof, involving the step of pumping a fluid into a wellbore. This includes pumping fluid into an injector well and recovering the hydrocarbon from a second wellbore. The fluid pumped may be a composition to increase the production of a hydrocarbon-bearing zone, or it may be a composition pumped into other zones to block their permeability or porosity. Methods of the invention may include pumping fluids to stabilize sections of the wellbore to stop sand production, for example, or pumping a cementatious fluid down a wellbore, in which case the fluid being pumped may penetrate into the completion (e.g. down the innermost tubular and then up the exterior of the tubular in the annulus between that tubular and the rock) and provide mechanical integrity to the wellbore. As used here in the phrases "treatment" and "servicing" are thus broader than "stimulation". In many applications, when the rock is largely composed of carbonates, one of the fluids may include an acid and the hydrocarbon increase comes from directly increasing the porosity and permeability of the rock matrix. In other applications, often sandstones, the stages may include proppant or additional materials added to the fluid, so that the pressure of the fluid fractures the rock hydraulically and the proppant is carried behind so as to keep the fractures from resealing. The details are covered in most standard well service texts and are known to those skilled in the well service art so are omitted here.

The present invention proposes unique methods and systems for reservoir and wellbore operations, such as well stimulation and completion, comprising in certain embodiments one or more of a wellhead-mounted or well pressure containment system-mounted reel for unspooling a communication line. The communication line may have one or more than one function. In certain embodiments the communication line may only communicate information, either one way or two-way between wellbore locations and the surface. In other embodiments the communication line may include one or more sensing devices at or near the distal end of the communication line. Systems of the invention may include a pressurized housing for the reel, a pumping system for conveying the communication line down the wellbore using one or more well treatment fluids, such as one or more well stimulation or other fluids, and optionally, depending on the embodiment, means for re-spooling the communication line, means for guiding the communication line down and back out of the wellbore, and a surface data acquisition and/or monitoring system.

In certain embodiments of the invention the sensing device is the communication line itself, such as when the communication line comprises one or more optical fibers. For example, an optical signal may traverse down the wellbore in the communication line at a certain wavelength, and return at another wave length or combinations of wavelengths. When the well service operation is a well stimulation, the stimulation fluids may be pumped into the wellbore in stages. One feature unique to the invention is that the fluid flow during the first stage or other stages of the stimulation may be used to convey or help covey the communication line through the wellbore. Data transmitted by the communication line may then be used to monitor subsequent stages of the stimulation. The first stage stimulation fluid may be a brine solution or an engineered pre-flush fluid. Subsequent stages may include proppant or other solid particles such as solid acids or encapsulated materials. Communication from the communication line to a surface data acquisition system may comprise wireless telemetry. The surface data acquisition system need not be at the well site, for example it may be a networked system including a computer at the well site and a second system at some remote location. The data transmitted may optionally be used to control the operation, whereby the pump rate or the composition of a treatment fluid is adjusted based purely upon the downhole data collected and transmitted by the communication line, or from a combination of downhole data and surface measurements. The data transmitted may be that from one or more sensors attached at the distal end of the communication line, or some other location on the communication line, or it may be data from a distributed section of the communication line such as distributed temperature along an optical fiber. The data collected may be stored on the acquisition system and the information used to optimize subsequent stimulation runs. Data may be select from pressure, temperature, pH, amount of precipitate, fluid temperature, depth, presence of gas, chemical luminescence, gamma-ray, resistivity, salinity, fluid flow, fluid compressibility, tool location, presence of a casing collar locator, tool state, tool orientation, and combinations thereof.

As used herein the term "oilfield" includes land based (surface and sub-surface) and sub-seabed applications, and in certain instances seawater applications, such as when hydrocarbon exploration, drilling, testing or production equipment is deployed through seawater. The term "oilfield" as used herein includes hydrocarbon oil and gas reservoirs, and formations or portions of formations where hydrocarbon oil and gas are expected but may ultimately only contain water, brine, or some other composition.

As stated earlier, as used herein "wellbore" means the innermost tubular of the completion system. This is different, for example, from systems wherein a small tubular is added to the annulus of the completion and a communication line is blown into that. In contrast, a fluid pumped to convey the communication line passes down the wellbore. In most embodiments, this would be a bull-heading job but it may include embodiments when a temporary tubular, such as a drill-pipe, is inserted into the completion. An advantage of the temporary tubular is that it allows more precise placement of the stimulation and/or treatment fluids, as well as reducing the tendency of the stimulation fluid affecting, and being affected by, the permanent tubulars (e.g., dissolving iron of the casing, blasting proppant against the production tube, and the like).

As used herein, the terms "BOP" and "blow-out preventer" are used generally to include any system of valves at the top of a well that may be closed if an operating crew loses control of formation fluids. The term includes annular blow-out preventers, ram blow-out preventers, shear rams, and well control stacks. By closing this valve or system of valves (usually operated remotely via hydraulic actuators), the crew usually regains control of the well, and procedures may then be initiated to increase the mud density until it is possible to open the BOP and retain pressure control of the formation.

A well control stack is a set of two or more BOPs used to ensure pressure control of a well. A typical stack might consist of one to six ram-type preventers and, optionally, one or two annular-type preventers. A typical stack configuration has the ram preventers on the bottom and the annular preventers at the top. The configuration of the stack preventers is optimized to provide maximum pressure integrity, safety and flexibility in the event of a well control incident. For example, in a multiple ram configuration, one set of rams might be fitted to close on 5-in. diameter drillpipe, another set configured for 4½-in. drillpipe, a third fitted with blind rams to close on the open hole and a fourth fitted with a shear ram that may cut and hang-off the drillpipe as a last resort. It is common to have an annular BOP or two on the top of the stack since annular BOPs may be closed over a wide range of tubular sizes and the open hole, but are typically not rated for pressures as high as ram preventers. The well control stack may also include various spools, adapters and piping outlets to permit the circulation of wellbore fluids under pressure in the event of a well control incident.

A "lubricator", sometimes referred to as a lubricator tube or cylinder, provides a method and apparatus whereby oilfield tools of virtually any length may be used in coiled or jointed tubing operations. In some embodiments use of a lubricator allows the coiled tubing injector drive mechanism to be mounted directly on the wellhead. An oilfield tool of any length may be mounted within a closed-end, cylindrical lubricator which is then mounted on the BOP. Upon establishment of fluid communication between the injector and the BOP and wellhead by opening of at least one valve, the oilfield tool is lowered from the lubricator into the wellbore with a portion of the tool remaining within the wellhead adjacent first seal rams located in the BOP which are then closed to engage and seal around the tool. The lubricator may then be removed and the injector head positioned above the BOP and wellhead. The tubing string is extended to engage the captured tool and fluid and/or electrical communication is established between the tubing and the tool. The injector drive mechanism (already holding/attached to the tubing string) may then be connected to the BOP or wellhead and the first seal rams capturing the tool are released and fluid communication is established between the wellbore and the tubing injector drive head. The retrieval and removal of the oilfield tool components are effected by performing the above steps in reverse order.

The optical fiber may typically be transported to the wellhead on a small drum. It may be introduced into the flow of the fluid by passing the fiber through a stuffing box such as disclosed in U.S. Pat. No. 3,831,676, in which case the reel is not subjected to the wellbore pressure. Alternatively, the fiber may be spooled onto a reel which is enclosed in a housing attached to the wellhead and thus subjected to the wellbore pressure, as described herein in reference to FIGS. 3A and 3B herein. The optical fiber may optionally be encased in a small amount of cladding for protection from abrasion and corrosion. The cladding may also help minimize long term darkening of the fiber caused by exposure to hydrogen ions. Rather than bringing a secondary coiled tubing unit to the location, instead the fiber is passed into the flow-path of the pumped treatment and/or stimulation fluids. The flowing fluid provides sufficient drag on the fiber that it may be conveyed the full length of the wellbore while the fluid is being bullheaded. Miniature sensors may be added to the end of the fiber to provide downhole pressure, flow, or other information. Alternatively, the fiber itself may be modified by the addition of gratings along its length. Surface interrogation of optical fiber gratings may be performed with a laser at the surface as disclosed, for example, in U.S. Pat. No. 5,841,131, incorporated herein by reference.

By "pumping system" we mean a surface apparatus of pumps, which may include an electrical or hydraulic power unit, commonly known as a powerpack. In the case of a multiplicity of pumps, the pumps may be fluidly connected together in series or parallel, and the energy conveying the communication line may come from one pump or a multiplicity. The pumping system may also include mixing devices to combine different fluids or blend solids into the fluid, and the invention contemplates using downhole and surface data to change the parameters of the fluid being pumped, as well as controlling on-the-fly mixing.

By the phrase "surface acquisition system" is meant one or more computers at the well site, but also allows for the possibility of a networked series of computers, and a networked series of surface sensors. The computers and sensors may exchange information via a wireless network. Some of the computers do not need to be at the well site but may be communicating via a communication system such as that known under the trade designation InterACT™ or equivalent communication system. In certain embodiments the communication line may terminate at the wellhead at a wireless transmitter, and the downhole data may be transmitted wirelessly. The surface acquisition system may have a mechanism to merge the downhole data with the surface data and then display them on a user's console.

In exemplary embodiments of the invention, advisor software programs may run on the acquisition system that would make recommendations to change the parameters of the operation based upon the downhole data, or upon a combination of the downhole data and the surface data. Such advisor programs may also be run on a remote computer. Indeed, the remote computer may be receiving data from a number of wells simultaneously.

The surface acquisition system may also include apparatus allowing communication to the downhole sensors. For example, in embodiments wherein the communication line includes an optical fiber, laser devices, such as diode lasers, may be used to interrogate the state of downhole optical components. Optionally, the laser devices may transmit a small amount of power to any downhole component on the end of the communication line. The surface acquisition system should be able to control the surface communication apparatus and the user's console would typically display status of those apparatus.

By using a sequence of stimulation fluids, one or more separate fluids may be pumped into the well. The first stage may be brine or an engineered pre-flush fluid. Subsequent stages may include proppant or other solid particles such as solid acids or encapsulated materials. In one embodiment, the first stage would be pumped until the desired length of the communication line is unspooled and would allow for a time interval to pass confirming this, if needed. For example, a distributed temperature may be run along the fiber and second stage of fluid pumped at a low rate until the distributed temperature value stabilized. Or the first stage may be pumped at a fixed rate until the pressure read at the bottom of the sensor no longer showed an increase in hydrostatic pressure. In an alternative embodiment, the communication line would be wound on a spool that gave an indication of spool number of revolutions and/or length of line unwound. The spool itself may include a brake mechanism to avoid the spool from "running away" faster than the fluid being pumped and stop when the desired line length is unspooled. That brake may be controlled by the surface acquisition system. The display on the user's console may include a representation of how much communication line had been pumped.

Communication lines useful in the invention may have a length much greater than their diameter, or effective diameter (defined as the average of the largest and smallest dimensions in any cross section). Communication lines may have any cross section including, but not limited to, round, rectangular, triangular, any conical section such as oval, lobed, and the like. The communication line diameter may or may not be uniform over the length of the communication line. The term communication line includes bundles of individual fibers, for example, bundles of optical fibers, bundles of metallic wires, and bundles comprising both metallic wires and optical fibers. Other fibers may be present, such as strength-providing fibers, either in a core or distributed through the cross section, such as polymeric fibers. Aramid fibers are well known for their strength, one aramid fiber-based material being known under the trade designation "Kevlar". In certain embodiments the diameter or effective diameter of the communication line may be 0.125 inch (0.318 cm) or less. In one embodiment, a communication line would include an optical fiber, or a bundle of multiple optical fibers to allow for possible damage to one fiber. U.S. patent application Ser. No. 11/111,230, filed on Apr. 21, 2005 (Adnan et al.) discloses one possible communication line wherein an Inconel tube is constructed by folding it around the optical fiber and then laser-welding the joint to close the tube. The resulting construction is referred to as an optical fiber tube, and is very rugged and may withstand severely abrasive and corrosive fluids, including hydrochloric and hydrofluoric acids. Fiber optic tubes are also available from K-Tube, Inc., of California, USA. An advantage of fiber optic tubes of this nature is that it is straightforward to attach sensors to the bottom of the tube. The sensors may be machined to be substantially the same or smaller diameter than the fiber optic tube, which minimizes the likelihood of the sensor getting ripped off the end of the tube during conveyance. Fiber optic tubes are not inexpensive, however, and thus certain embodiments of the invention comprise retrieving the sensors by reverse spooling so that the tube may be reused. The reverse spooling may be controlled by the surface acquisition system, but also may be a standalone apparatus added after the stimulation process is complete. A possible disadvantage of the fiber optic tubes using thin Inconel layers is that they may not be readily respoolable because the Inconel layer is so thin. In embodiments wherein it is desired to respool the device, a thicker layer of metal may be used. This slickline is more expensive but has proven to withstand multiple respoolings.

In an alternative embodiment, the communication line may comprise a single optical fiber having a fluoropolymer or other engineered polymeric coating, such as a Parylene coating. The advantage of such a system is the cost is low enough to be disposable after each job. One disadvantage is that it needs to be able to survive being conveyed into the well, and survive the subsequent fluid stages, which may include proppant stages. In these embodiments, a long blast tube or joint comprising a very hard material, or a material coated with known surface hardeners such as carbides and nitrides may be used. The communication line would be fed through this blast tube or joint. The length of blast joint may be chosen so that the fluid passing through the distal end of the joint would be laminar. This length may be dozens of feet or meters, so the blast joint may be deployed into the wellbore itself. In embodiments where the communication line is a single fiber, the sensing apparatus may need to be very small. In these embodiments, nano-machined apparatus that may be attached to the end of the fiber without significantly increasing the diameter of the fiber may be used. Similar devices are marketed for downhole pressure measurement by Sensa, Southampton, United Kingdom. A small sheath may be added to the lowest end of the fiber and cover the sensing portion so that any changes in outer diameter are very gradual.

In one embodiment of the invention the sensing device is the communication line itself. For example, the communication line may include an optical fiber, and the data transmitted may be distributed temperature. Accessing distributed temperature is known in the art, except for the teachings herein, and has been disclosed, for example, by U.S. Pub. Pat. App. No. US20040129418, "Use of distributed temperatures during wellbore treatments" by Jee, et al., incorporated by reference herein. Alternatively, an optical fiber itself may be modified by the addition of doping or gratings along its length. Surface interrogation of these gratings may be done with a laser at the surface as disclosed, for example, in U.S. Pat. No. 5,841,131 "Fiber optic pressure transducers and pressure sensing system incorporating same", by Schroeder et al., incorporated by reference herein.

One important advantage of intrinsic modifications to optical fibers is that they may be engineered so that they do not increase the outer-diameter of the fiber, which means much less turbulence and drag along the communication line.

Data transmitted from the communication line may be used to monitor subsequent stages of reservoir or wellbore treatment. The data transmitted may optionally be used to control some or all of the treatment operation, whereby for example a pump rate or composition of a fluid being injected is adjusted based purely on the downhole data obtained by the communication line, or from a combination of downhole data and surface measurements. The downhole data transmitted may be that from one or more sensors attached to the end of one or more communication lines, and may supplement or be supplemented by a variety of other measurements. The data may be from a distributed section of a communication line such as distributed temperature along an optical fiber. The data collected may be stored on the acquisition system and the information used to optimize and/or model subsequent stimulation runs.

Referring now to the figures, FIG. 1 illustrates schematically, and not to scale, a partial cross-sectional view of a prior art system embodiment 1 required to deploy a communication slick line or wire line, designated as 2, into a well. Communication line 2 is usually kept spooled on a drum 4 kept some distance away from wellhead 18. Typically an operator sits in an operator station 6. Communication line 2 passes over sheaves 7 and 8 prior to passing into the top of a lubricator or stuffing box 10. Lubricator or stuffing box 10 forms the pressure barrier around communication line 2 at its entry point. The remainder of the parts shown complete the well control stack, such as connectors 12 and 16, and BOPs 14.

Figure 2:
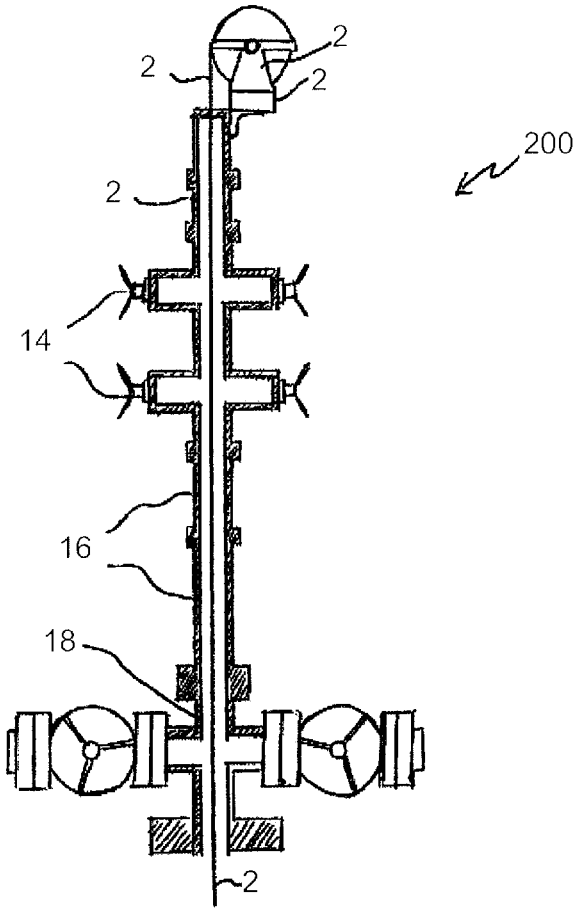
FIG. 2 is a schematic partial cross-sectional view of one embodiment of the invention.

FIG. 2 is a schematic partial cross-sectional view of one embodiment, 200, of the invention. Communication line 2 is deployed from a communication line deployment reel 30 mounted directly via a bracket 32 onto stuffing box or lubricator 10. Alternatively, reel 30 could be mounted directly to the top-most BOP 14. This embodiment and its functional variations eliminate or greatly reduce bends in communication line 2 that may result in fatigue and ultimate failure of communication line 2. A drive mechanism (not shown) for reel 30 may be mounted directly on the well control stack, for example on lubricator 10, or it could be located on some other surface or platform. Data retrieved from the wellbore may be collected at the hub of the spool of reel 30. Embodiment 200 and its functional and structural equivalents may reduce rig up and rig down time, as well as require fewer pieces of equipment, and is less complex to implement compared to systems such as depicted in FIG. 1.

Figures 3A, 3B:
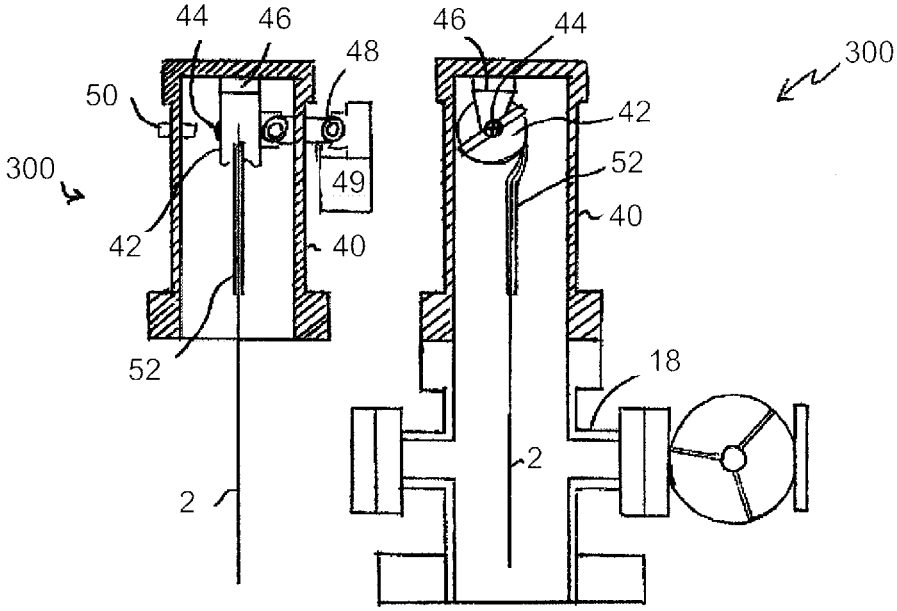
FIGS. 3A and 3B are schematic partial cross-sectional views of a second embodiment of the invention.

FIGS. 3A and 3B are schematic partial cross-sectional views of a second embodiment 300 of the invention. Embodiment 300 contains an optical fiber reel 42, a drive mechanism 48, and a data interface 44 in a small, high-pressure housing 40. A bracket 46 attaches reel 42 to an inside wall of housing 40. In order to rig up such a device, the operator would only need to flange up housing 40 to the top of wellhead 18. Housing 40 would have no fluid leak paths and require minimal pressure testing. Power to turn reel 42 may be delivered magnetically through a nonmagnetic wall using a high-torque magnetic coupling. In these embodiments, an electrical or hydraulic motor 49 could turn drive mechanism 48 from outside of housing 40 without having to penetrate the housing wall. In certain systems of this aspect of the invention, the drive mechanism for reel 42 could be located within housing 40, as well as a data interface 50. In system embodiments wherein communication line 2 is an optical fiber, the optical signal may be diffused (to improve contamination tolerance) at the optical connector device, passed from a rotating hub of the reel to a diffused optical connector which refocuses the optical signal to the diameter of the optical fiber. The optical fiber would then be passed through an optical pressure bulkhead in the housing wall and be available outside the housing. This may be a full duplex arrangement, wherein light beams may travel into and out of the wellbore.

If communication line 2 is a micro-wire, then an electrical signal may be converted into a wireless signal to bypass the need for a signal collector at the hub of the reel. In these embodiments, a receiver device might simply comprise a non-EMF-blocking port in housing 40 (comprising materials such as plastics, quartz, ceramic, or combination thereof).

The optical fiber or micro-wire communication line may be guided into an appropriate position in the well flow by an articulating guide 52, which is able to move left and right in FIG. 3A, and optionally left and right in FIG. 3B. The appropriate position in the well flow may be a function of well type, type of well treatment and the phase (stage) of the treatment. For example, during deployment it may be beneficial to center the communication line in the well flow so as to maintain the maximum possible frictional drag on the communication line. However, during high velocity or abrasive treatments, it may be beneficial to move the communication line to one side (in the least turbulent or least destructive (to the fiber) part of the flow). In certain embodiments, when the communication line is a small diameter fiber used in fracturing service, it may be more economical to simply leave the fiber in the well. However, in other embodiments, such as well logging operations, it may make more sense to retrieve the fiber from the well. If the communication line is a micro-wire (single or multi conductor) it too may be made of materials (such as zinc or aluminum) that would not last long in a well or that may simply be dissolved by an acid flush. In embodiments wherein the communication line comprises one or more multi-use micro-wires, the micro-wires may comprise materials (Inconel, Monel, and the like) that are not harmed by typical well treatment fluids.

Figure 4:
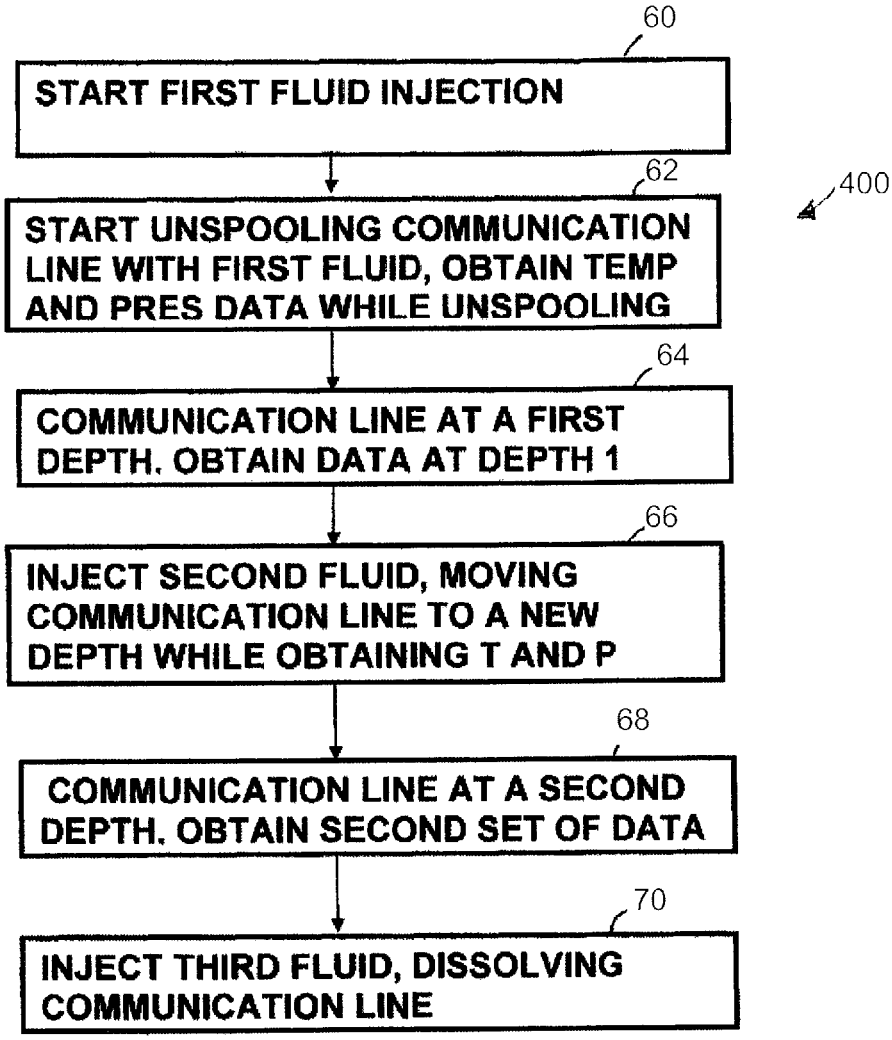
FIG. 4 is a schematic process information flow sheet that may be useful in understanding certain embodiments of the invention.

FIG. 4 is a schematic process information flow sheet of a method embodiment 400 that may be useful in understanding certain features of the invention. Box 60 represents a starting point for injection of a first treatment fluid, which may be a brine or other fluid. During this injection of brine, start unspooling the communication line with the first fluid, and obtain temperature and pressure data while unspooling the communication line, as illustrated at box 62. Once the communication line is at a first depth, data at that specific depth may be obtained, as depicted at box 64. Then a second treatment fluid may be injected, at box 66, moving the communication line to a new depth while obtaining pressure and temperature data during this second movement of the communication line. After reaching this second depth, a second set of temperature and pressure data may be obtained at this second depth, as illustrated at box 68. As a final step 70, a third treatment fluid might be injected, for example an acid solution, if it is decided to dissolve the communication line. Those skilled in the well servicing art will recognize many possible variations of this basic method. For example, the data transmitted to the surface through the communication line may be used to control the rate of injection of one or any of the fluids; the composition of the fluids may be changed "on-the-fly" using data gathered downhole, and so on.

Although only a few exemplary embodiments of this invention have been described in detail above, those skilled in the art may readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. A method of introducing a fiber optic tether into a wellbore proximate a reservoir, comprising:

performing a well operation by pumping at least a first treatment fluid through the wellbore and into the reservoir;

propelling the fiber optic tether into the wellbore without a well control stack, the fiber optic tether being propelled into the wellbore by controlling the pumping of the first treatment fluid and controlling a powered reel, the reel being internal to a pressurized housing connected to a wellhead of the wellbore;

performing a treatment operation with at least a second treatment fluid; and sensing downhole data related to a wellbore condition with the fiber optic tether while the fiber optic tether is propelled into the wellbore and while performing the treatment operation, the downhole data used to control the propelling of the fiber optic tether and at least a portion of the treatment operation.

2. The method of claim 1 comprising connecting the housing and reel directly to the wellhead prior to introducing the fiber optic tether into the pressurized wellbore.

3. The method of claim 1 comprising flanging the housing directly to the wellhead.

4. The method of claim 1 further comprising powering the reel by delivering power magnetically through a non-magnetic wall of the housing.

5. The method of claim 4 comprising diffusing an optical signal using a first optical connector, transmitting the diffused signal through the optical fiber to a second optical connector, and refocusing the signal to the diameter of the optical fiber.

6. The method of claim 5 comprising transmitting the signal through an optical pressure bulkhead in a wall of the housing.

7. The method of claim 4 comprising transmitting optical signals in both directions through the optical fiber, the optical fiber comprising one or more than one optical fiber.

8. The method of claim 1 comprising guiding the fiber optic tether into the pressurized wellbore employing a guide mechanism, the guiding comprising adjusting the position of the fiber optic tether relative to a centerline of the wellbore using the guiding mechanism based on composition of the treatment fluid.

9. The method of claim 8 comprising retrieving the fiber optic tether from the pressurized wellbore using the guide mechanism.

10. The method of claim 1 comprising leaving the fiber optic tether in the wellbore and dissolving the fiber optic tether by chemical, thermal, or physical action or combination of these actions.

11. The method of claim 1 comprising pumping two or more treatment fluids into the wellbore.

12. The method of claim 11 comprising pumping two or more treatment fluids into the wellbore in succession to drive the fiber optic tether into the wellbore.

13. The method of claim 11 comprising mixing or combining treatment fluids and/or solids prior to pumping the treatment fluids into the wellbore.

14. The method of claim 11 comprising controlling the mixing or combining using data obtained from data selected from the group consisting of the wellbore, surface data, and some combination thereof.

15. The method of claim 1 wherein sensing further comprises acquiring wellbore data using a surface data acquisition system.

16. The method of claim 11 comprising pumping a first treatment fluid into the wellbore to unspool the fiber optic tether, followed by one or more subsequent treatment fluids.

17. The method of claim 11 comprising respooling the fiber optic tether.

18. The method of claim 1 wherein sensing comprises sensing a wellbore condition employing methods selected from the group consisting of a sensor attached to a distal end of the optical fiber, gratings on the optical fiber, doping of the fiber, and combinations thereof.

19. The method of claim 1 comprising using the sensed wellbore condition data to monitor or model subsequent well operations.

20. The method of claim 1 wherein the propelling comprises controlling unspooling and spooling of the fiber optic tether from or onto the reel, the controlling selected from the group consisting of automatic, electronic, computerized, and combinations thereof.

21. The method of claim 20 wherein the reel is instrumented to measure and control line unspooling/spooling length based on a controller input via a communication port, the communications port selected from wire, wireless, or combination thereof.

22. The method of claim 1, wherein the fiber optic tether comprises a metal tube around at least one optical fiber.

23. The method of claim 1, wherein the fiber optic tether is approximately 0.125 inches in diameter or less.

24. The method of claim 1 further comprising adjusting the well operation based on the sensed condition.

25. The method of claim 1, comprising controlling pumping of the treatment fluid based on the wellbore condition sensed while the fiber optic tether is propelled into the wellbore, wherein controlling pumping of the treatment fluid comprises adjusting a pump rate of the treatment fluid or adjusting a treatment fluid composition.

26. A system comprising:

a pressure containment housing fluidly connected to a wellhead of a wellbore without a well control stack;

a reel positioned inside the housing on which is spooled a fiber optic tether;

a drive mechanism for the reel located within the housing; and a surface data acquisition system configured to obtain surface measurements and monitor and store downhole data from a well operation transmitted along the fiber optic tether when the fiber optic tether is disposed in the wellbore, wherein the surface data acquisition system is configured to receive and store downhole data corresponding to a wellbore condition sensed with the fiber optic tether while the fiber optic tether is propelled into the wellbore by a treatment fluid and the drive mechanism, the surface data acquisition system further configured to control a wellbore operation based on downhole data and/or surface measurements.

27. The system of claim 26 wherein power to turn the reel is delivered magnetically though a non-magnetic housing wall or portion of wall using a magnetic coupling.

28. The system of claim 26 wherein the housing comprises a receiver device comprising a non-EMF-blocking port in the housing comprising materials selected from the group consisting of plastics, quartz, ceramic, or combination thereof.

29. The system of claim 26 comprising an articulating guide adapted to guide the fiber optic tether into an appropriate position in the well flow based on a composition of the treatment fluid or a phase of the treatment.

30. The system of claim 26 comprising one or more control components adapted to control unspooling of the reel, the control components selected from the group consisting of automatic, electronic, computerized, and combinations thereof.

31. The system of claim 26 wherein the surface data acquisition system is configured to model subsequent well operations based on the stored data.

32. The system of claim 26 wherein the surface data acquisition system is configured to control the operation of the system.

* * * * *